US009638498B2

(12) United States Patent
Chang

(10) Patent No.: US 9,638,498 B2
(45) Date of Patent: May 2, 2017

(54) CARTRIDGE OF NON-LETHAL WEAPON

(71) Applicant: Hong Yih Chang, Taichung (TW)

(72) Inventor: Hong Yih Chang, Taichung (TW)

( * ) Notice: Subject to any disclaimer, the term of this patent is extended or adjusted under 35 U.S.C. 154(b) by 0 days.

(21) Appl. No.: 15/047,685

(22) Filed: Feb. 19, 2016

(65) Prior Publication Data

US 2016/0258718 A1 Sep. 8, 2016

(30) Foreign Application Priority Data

Mar. 6, 2015 (TW) ..... 104203336 A

(51) Int. Cl.

| | |
|---|---|
| ***F42B 12/36*** | (2006.01) |
| ***F42B 6/00*** | (2006.01) |
| ***F41B 11/56*** | (2013.01) |
| ***F41B 11/62*** | (2013.01) |
| ***F41H 13/00*** | (2006.01) |
| ***F42B 12/46*** | (2006.01) |

(52) U.S. Cl.

CPC ..... *F41H 13/0025* (2013.01); *F41B 11/56* (2013.01); *F41B 11/62* (2013.01); *F41H 13/0031* (2013.01); *F42B 6/003* (2013.01); *F42B 12/36* (2013.01); *F42B 12/362* (2013.01); *F42B 12/46* (2013.01)

(58) Field of Classification Search

CPC ..... F41B 11/56; F41B 11/62; F41H 13/0012; F41H 13/0025; F41H 13/0031; F42B 6/00; F42B 6/003; F42B 6/02; F42B 12/36; F42B 12/362; F42B 12/46

USPC ..... 124/74, 41.1, 44.7; 102/438, 439, 502

See application file for complete search history.

(56) References Cited

U.S. PATENT DOCUMENTS

| | | | | |
|---|---|---|---|---|
| 7,314,007 | B2 * | 1/2008 | Su | F41H 13/0025 102/502 |
| 8,339,763 | B2 * | 12/2012 | McNulty, Jr. | F41B 15/04 361/232 |
| 8,441,771 | B2 * | 5/2013 | Hinz | F41H 13/0025 102/502 |
| 9,080,840 | B2 * | 7/2015 | Klug | F41H 13/0025 |
| 9,157,694 | B1 * | 10/2015 | Tseng | F41B 11/62 |
| 9,267,768 | B1 * | 2/2016 | Chang | F41H 13/0025 |

* cited by examiner

*Primary Examiner* — James S Bergin

(57) ABSTRACT

A cartridge of a non-lethal weapon includes a housing in a launching device and including an internal space, a piercing member on a rear end of the space, a channel through the piercing member to communicate the space with at least one projectile, a metal sleeve at a front end of the space, and internal threads on an inner surface of the sleeve wherein the sleeve, the piercing member, and the housing are formed integrally; a high-pressure air canister in the space; a cap including two front through holes, external threads adjacent to the through holes, an internal primer between the through holes, and at least one spacer between the primer and the air canister wherein the cap is in the sleeve with the external threads and the internal threads secured together; and a first washer sandwiched by and between the cap and the inner surface of the space.

7 Claims, 10 Drawing Sheets

CARTRIDGE OF NON-LETHAL WEAPON

BACKGROUND OF THE INVENTION

1. Field of the Invention

The invention relates to non-lethal weapons and more particularly to a structurally strong, durable cartridge of a non-lethal weapon.

2. Description of Related Art

Law enforcement officers (e.g., riot police) may use non-lethal weapons such as pepper sprays, electric batons, and/or stun guns when enforcing law. Among the above non-lethal weapons, the stun guns are most effective. However, after a long period time of non-use, the stun guns may jam when in use again.

A conventional cartridge of a non-lethal weapon is shown in FIG. 10. The piercing member 10 may be displaced after many times of use because its mounting is not secured. Further, pressurized air may leak from threaded connections within the cartridge in use. And in turn, it may shorten the effective firing range of a projectile. Furthermore, it tends to jam and may cause danger to law enforcement officers.

Thus, the need for improvement still exists.

SUMMARY OF THE INVENTION

It is therefore one object of the invention to provide a cartridge of a non-lethal weapon comprising a housing disposed in a launching device and including an internal space, a piercing member disposed on a rear end of the internal space, a channel through the piercing member to communicate the internal space with at least one projectile, a metal sleeve disposed at a front end of the space, at least one annular ridge formed on an outer surface of the sleeve, and internal threads formed on an inner surface of the metal sleeve wherein the sleeve and the piercing member are formed integrally in the housing in an injection molding; a high-pressure air canister disposed in the internal space and proximate the piercing member; a cap including two front through holes, external threads adjacent to the front through holes, an internal primer disposed between the front through holes, at least one spacer disposed between the primer and the air canister, and an annular projection disposed on an end of the internal space and configured to complimentarily secure to the piercing member wherein the cap is disposed in the sleeve with the external threads and the internal threads secured together; and a first washer sandwiched by and between the cap and the inner surface of the internal space.

The above and other objects, features and advantages of the invention will become apparent from the following detailed description taken with the accompanying drawings.

DETAILED DESCRIPTION OF THE INVENTION

Figure 1:
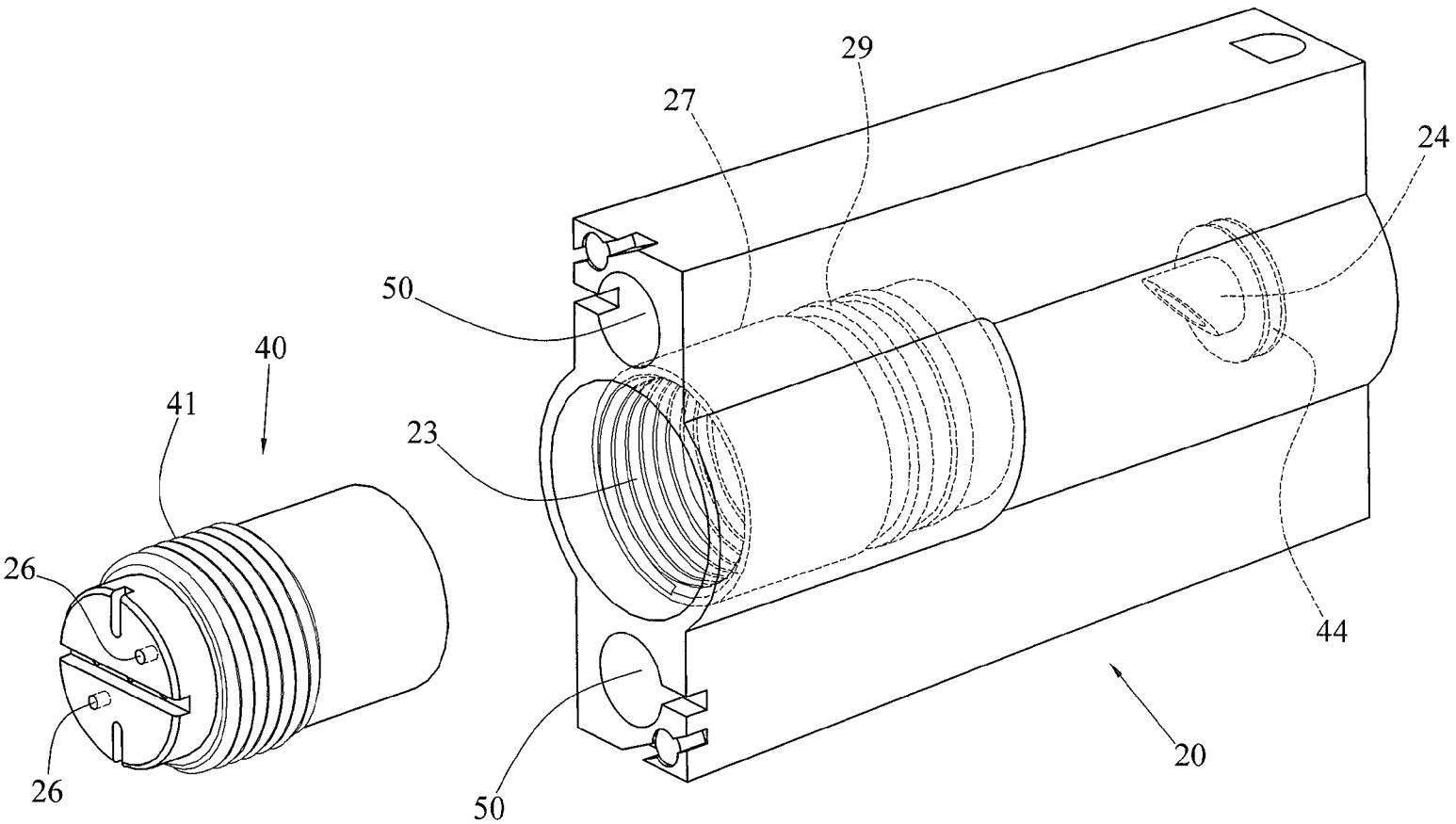
FIG. 1 is a perspective view of a housing and a separate cap of a cartridge of a non-lethal weapon according to a first preferred embodiment of the invention.
Figure 2:
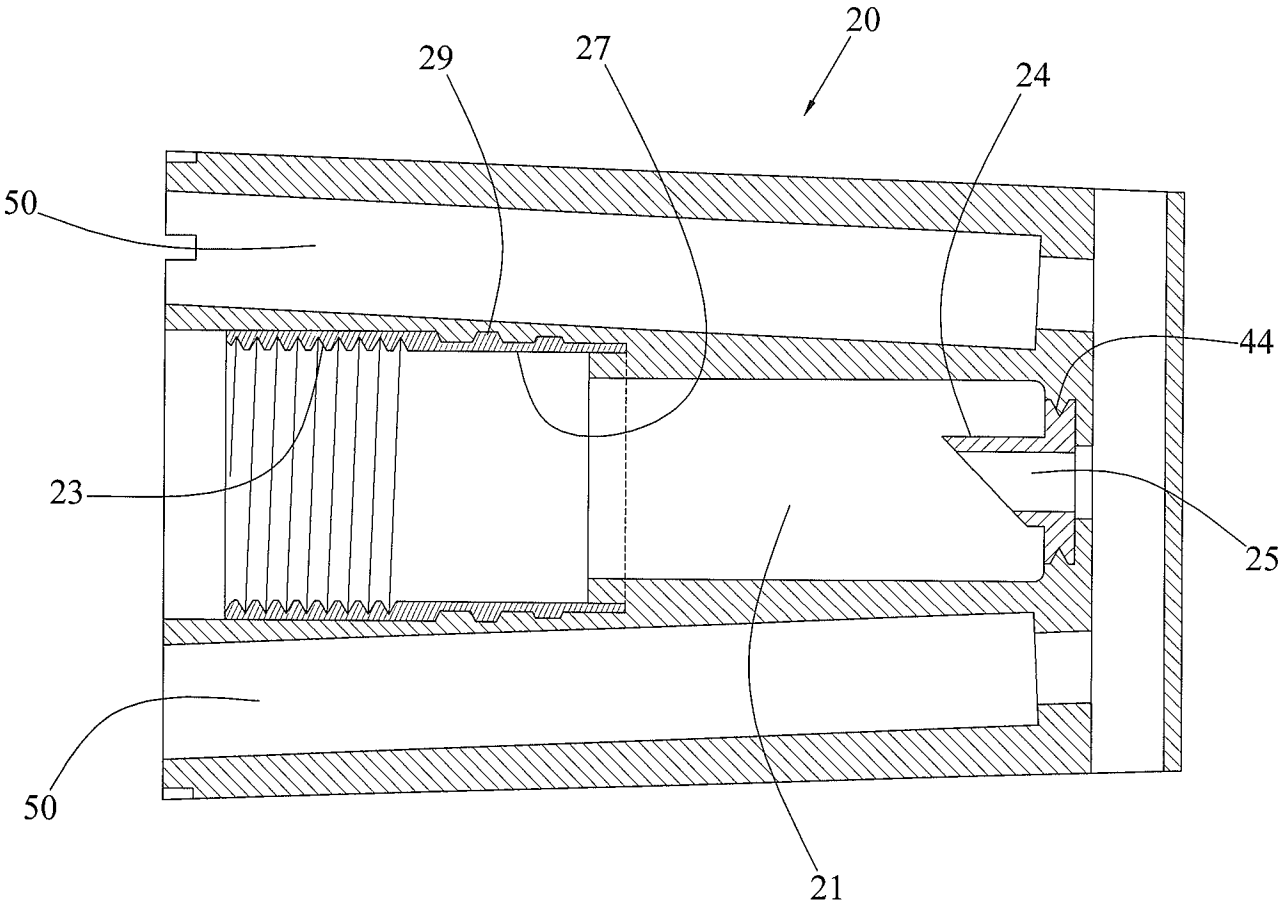
FIG. 2 is a longitudinal sectional view of the housing.
Figure 3:
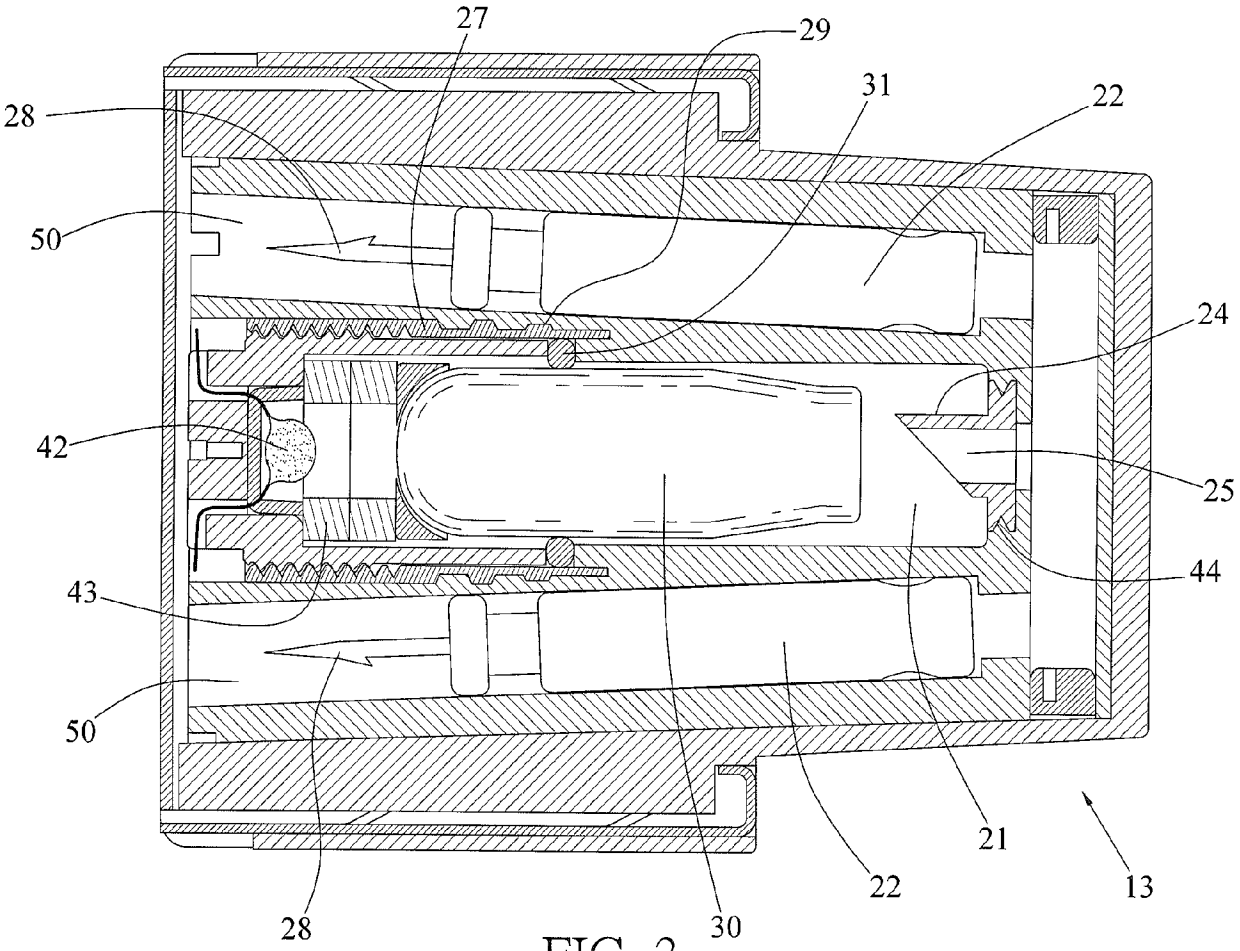
FIG. 3 is a longitudinal sectional view of a launching device including the housing with the cap fastened therein and two projectiles and a high-pressure air canister mounted therein.
Figure 4:
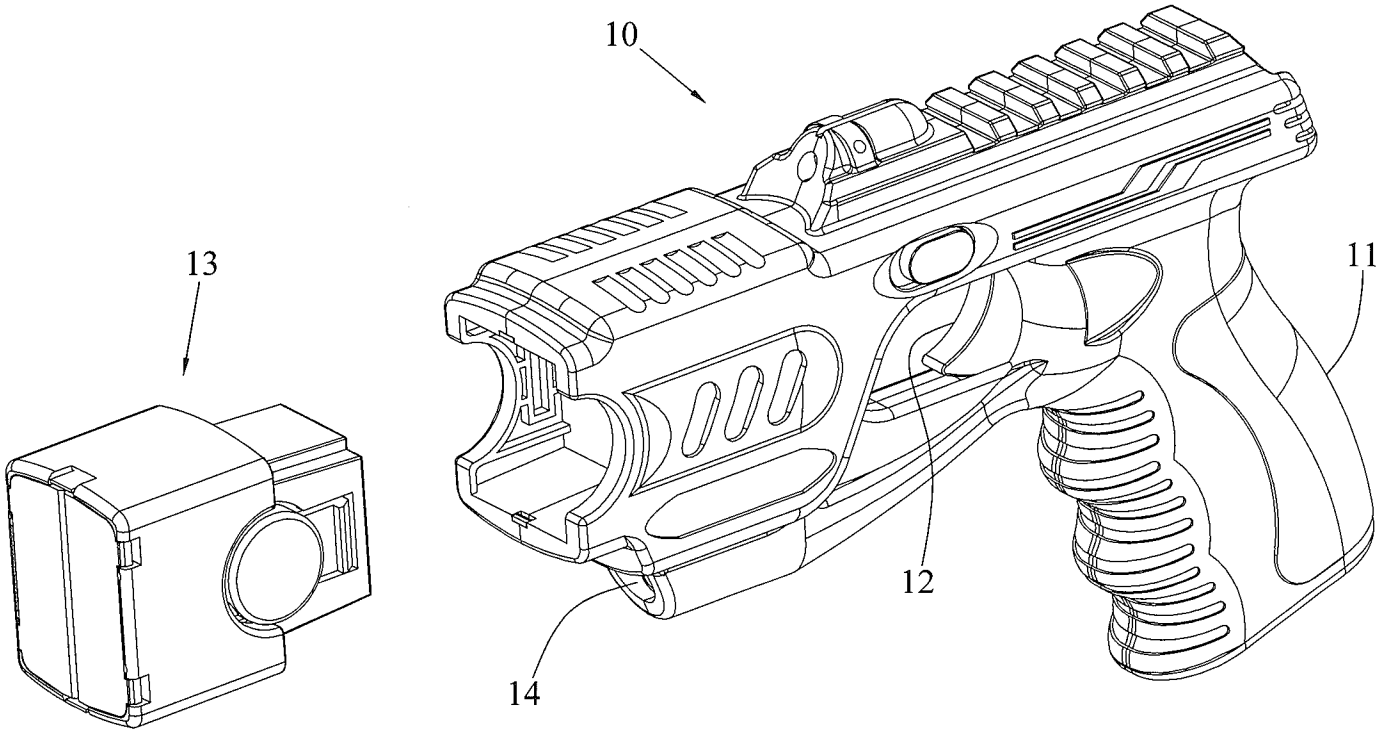
FIG. 4 is a perspective view of a stun gun with the launching device detached.

Referring to FIGS. 1 to 4, a cartridge of non-lethal weapon in accordance with a first preferred embodiment of the invention comprises the following components as discussed in detail below.

A housing 20 is provided in a launching device 13 and includes an internal space 21, a hollow piercing member 24 provided on a rear end of the space 21, a channel 25 through the piercing member 24 to communicate the space 21 with two projectiles 22 located in two inclined tunnels 50 above and under the space 21 respectively, a metal sleeve 27 provided at a front end of the space 21, a plurality of annular ridges 29 formed on an outer surface of a rear portion of the sleeve 27, and internal threads 23 formed on an inner surface of a front portion of the sleeve 27. The sleeve 27 and the piercing member 24 are formed integrally in the housing 20 in an injection molding.

A high-pressure air canister 30 is provided in the space 21 and proximate the piercing member 24. A cylindrical cap 40 includes two front through holes 26, external threads 41 formed on a front portion adjacent to the through holes 26, an internal primer 42 provided between the through holes 26, a plurality of spacers 43 provided between the primer 42 and a front end of the air canister 30, and an annular projection 44 provided on a blind end of the space 21 for complimentarily securing to a rear end of the piercing member 24. The cap 40 is disposed in the sleeve 27 with the external threads 41 and the internal threads 23 secured together. Further, a washer 31 is sandwiched by and between the cap 40 and a shoulder on an inner surface of the space 21.

The projectile 22 has a forward dart 28. The sleeve 27 is made of copper or steel. The launching device 13 is provided in a front tubular portion of a stun gun 10 which includes a light 14 under the launching device 13, a butt 11 and a trigger 12.

Figure 5:
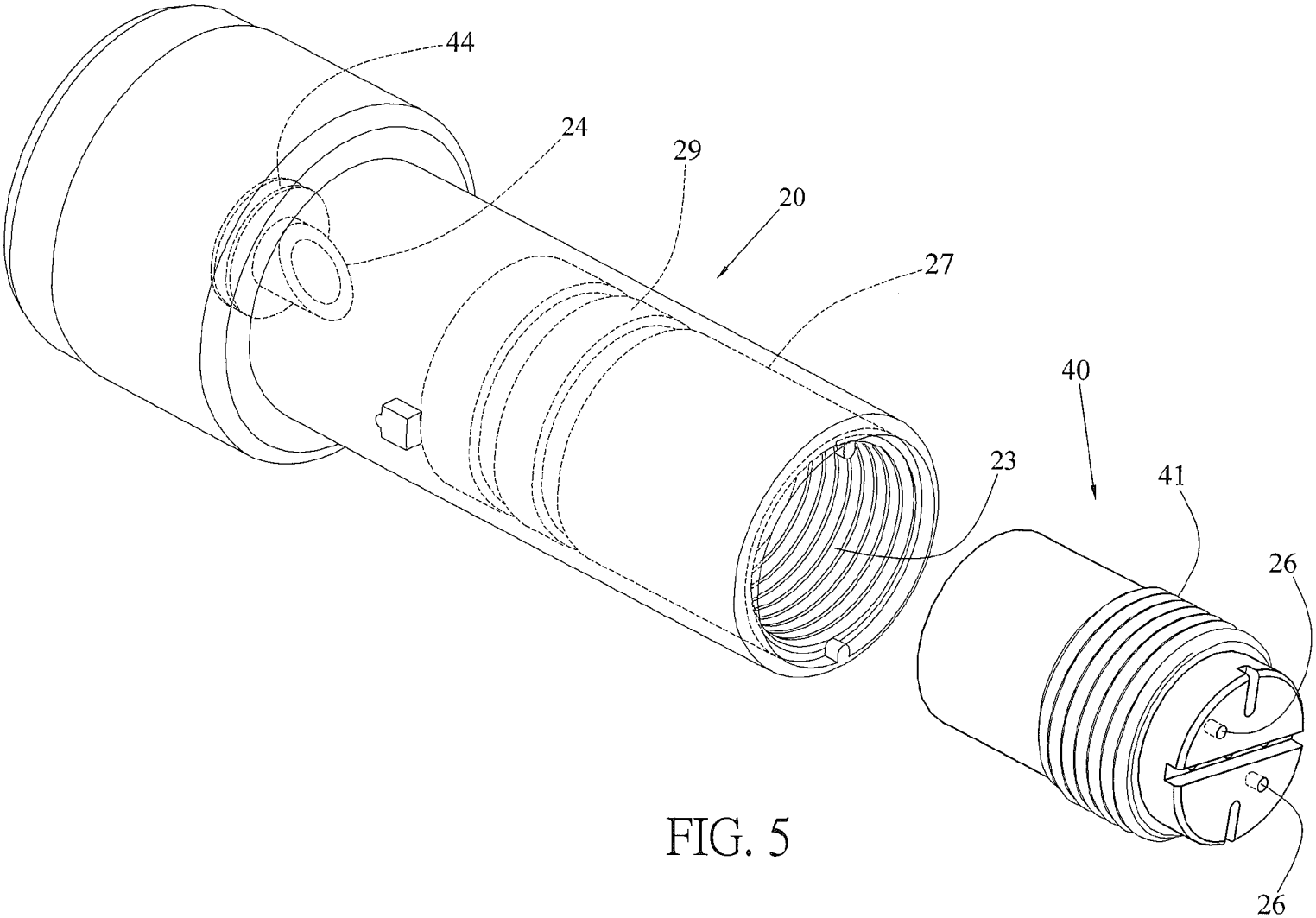
FIG. 5 is a perspective view of a housing and a separate cap of a cartridge of a non-lethal weapon according to a second preferred embodiment of the invention.
Figure 6:
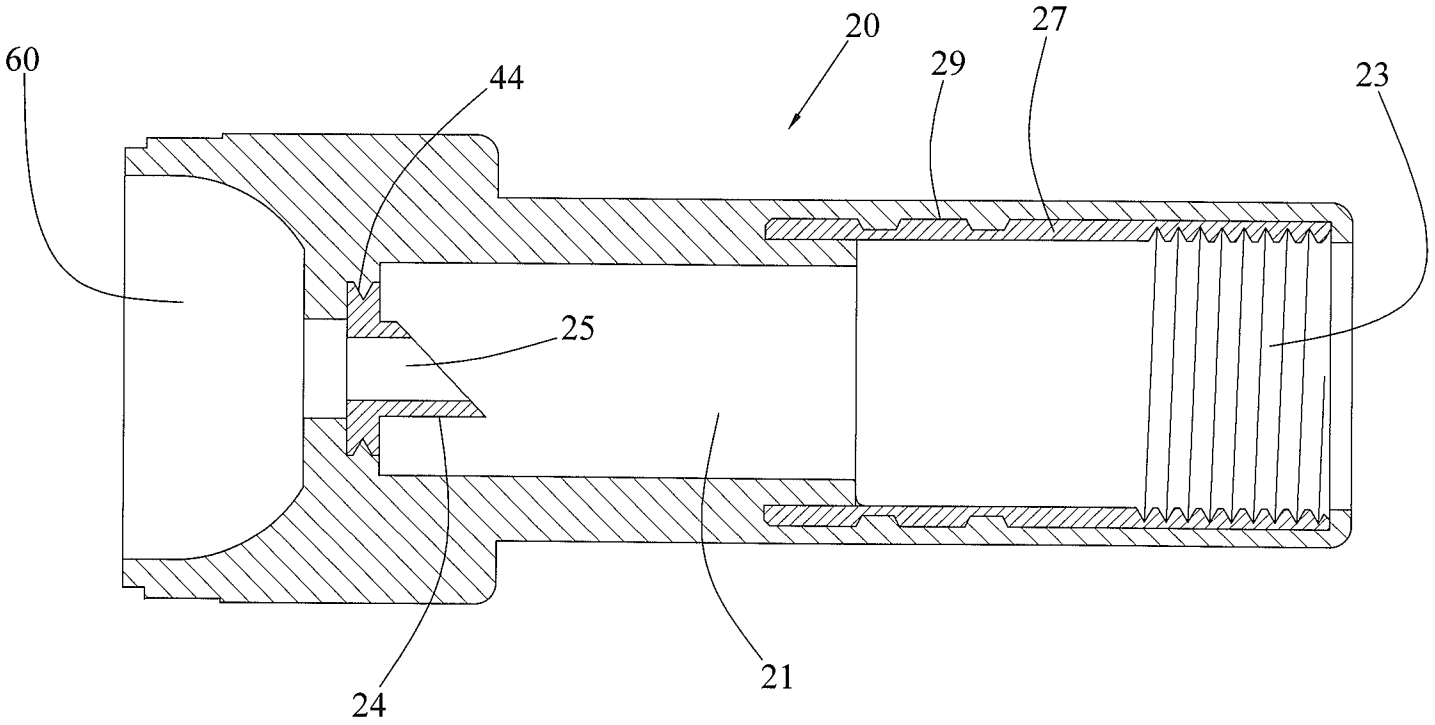
FIG. 6 is a longitudinal sectional view of the housing of FIG. 5.
Figure 7:
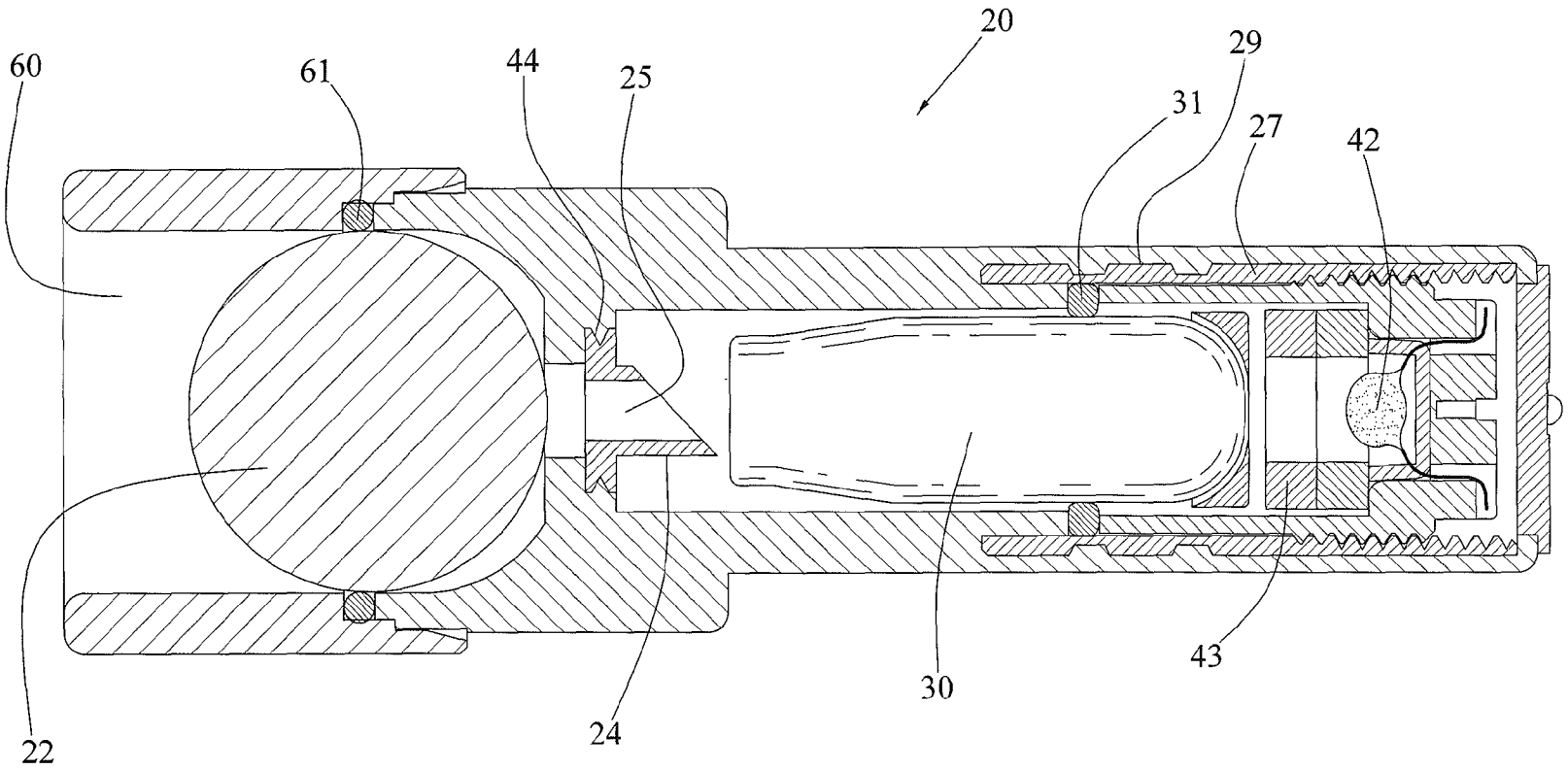
FIG. 7 is a longitudinal sectional view of the housing with the cap fastened therein and a projectile and a high-pressure air canister mounted therein.
Figure 8:
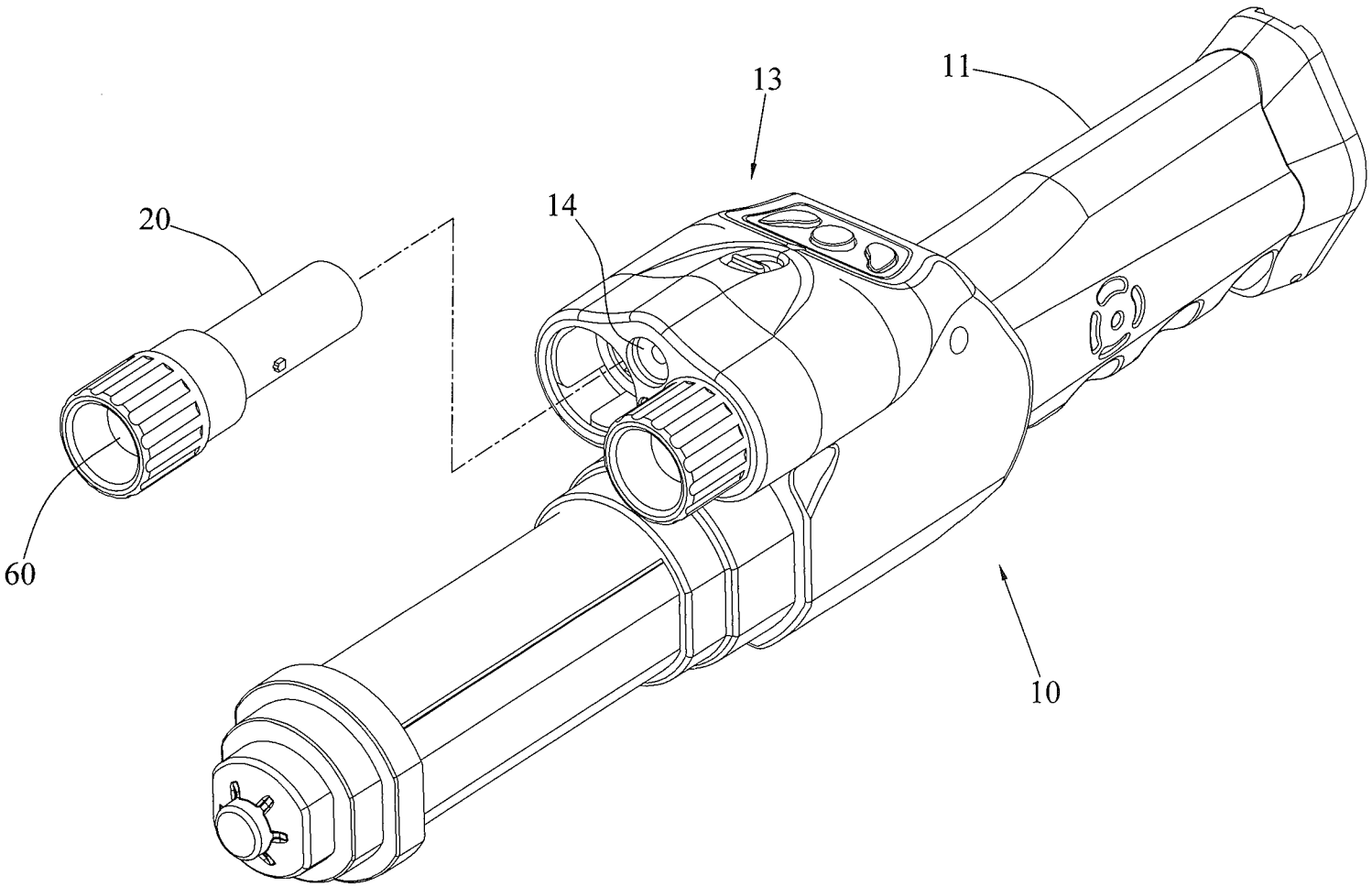
FIG.8 is a perspective view of a stun gun with a mounted launching device.
Figure 9:
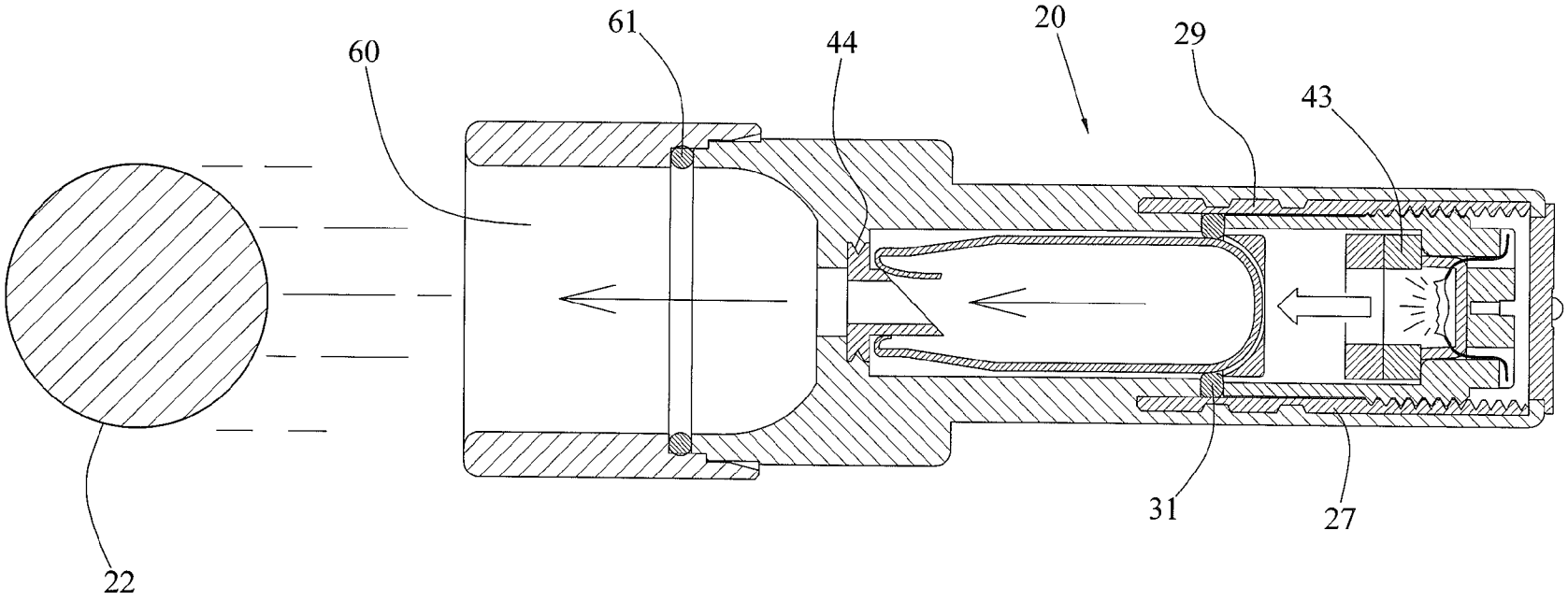
FIG. 9 is a view similar to FIG. 7 with the projectile propelled from the housing.
Figure 10:
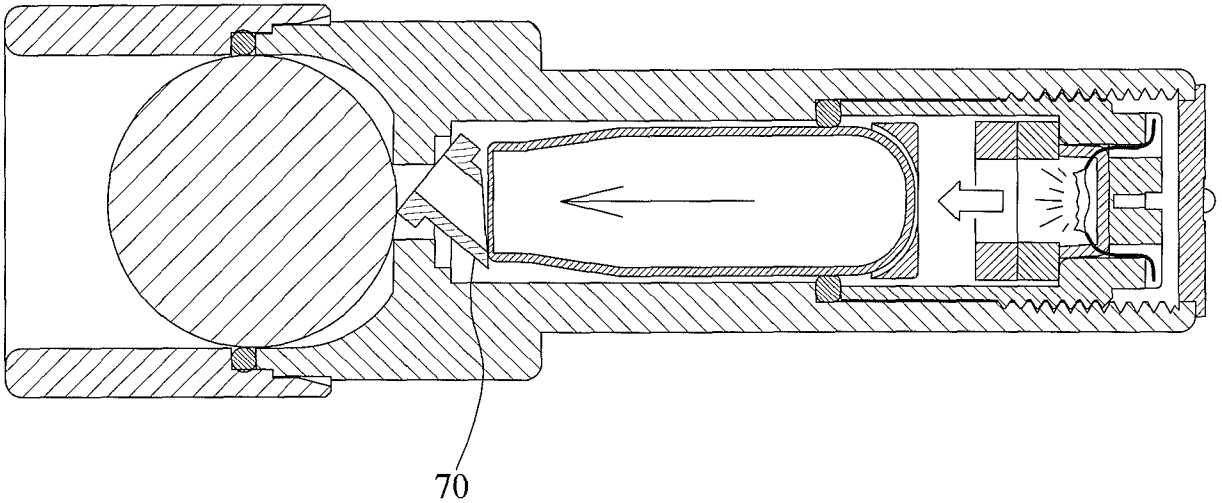
PRIOR ART FIG. 10
FIG. 10 is a longitudinal sectional view of a housing with a cap fastened therein and a projectile and a high-pressure air canister mounted therein according to the prior art cartridge of a non-lethal weapon.

Referring to FIGS. 5 to 9, a cartridge of non-lethal weapon in accordance with a second preferred embodiment of the invention is shown. The characteristics of the second preferred embodiment are substantially the same as that of the first preferred embodiment except the following:

The projectile 22 is provided in a front chamber 60 which communicates with the channel 25 through the piercing member 24. A plurality of annular ridges 29 are formed on an outer surface of a front portion of the sleeve 27. An annular projection 44 is provided on a front end of the space 21 for complimentarily securing to a front end of the piercing member 24. A washer 61 is sandwiched by and between the chamber 60 and a front end of the housing 20 to hold the projectile 22 in place. The projectile 22 is a Capsicum annuum ball or pepper ball. The sleeve 27 is made of copper or steel. The launching device 13 is provided on a top of an intermediate portion of a stun gun 10 which includes a light 14 in the launching device 13, a butt 11 and a trigger (not shown).

In the manufacturing process of the first preferred embodiment of the invention, the sleeve 27, the piercing member 24 and the housing 20 are formed integrally. In a firing operation of the first preferred embodiment, a user may press the trigger 12 to supply electric current to the primer 42 via the housing 20. The primer 42 thus explodes to push the air canister 30 toward the piercing member 24 which pierces through the opening of the air canister 30. Pressurized air in the air canister 30 flows to the tunnels 50 to propel the darts 28 from the launching device 13. One dart 28 is electrically conducive and has a positive electrode and the other dart 28 is electrically conductive and has a negative electrode. Both the darts 28 are electrically connected to a power source (not shown) in the stun gun 10 via electric wires (not shown). A human target can be incapacitated when he/her is hit by the darts 28.

It is envisaged by the invention that the piercing member 24 is secured after a great number of times of firing and the housing 20 is structurally strong without being broken after many times of firing.

In the manufacturing process of the second preferred embodiment of the invention, the sleeve 27, the piercing member 24 and the housing 20 are formed integrally. In a firing operation of the second preferred embodiment, a user may press the trigger to supply electric current to the primer 42 via the housing 20. The primer 42 thus explodes to push the air canister 30 toward the piercing member 24 which pierces through the opening of the air canister 30. Pressurized air in the air canister 30 quickly flows to the chamber 60 to propel the projectile 28 from the launching device 13. A human target can be incapacitated when he/her is hit by the projectile 28.

It is envisaged by the invention that the piercing member 24 is secured after a great number of times of firing and the housing 20, with the provision of the metal sleeve 27, is structurally strong without being broken after many times of firing.

While the invention has been described in terms of preferred embodiments, those skilled in the art will recognize that the invention can be practiced with modifications within the spirit and scope of the appended claims.

What is claimed is:

1. A cartridge comprising:

a housing disposed in a launching device and including an internal space, a piercing member disposed at a rear end of the internal space, a channel through the piercing member to communicate the internal space with at least one projectile, a metal sleeve disposed at a front end of the space, at least one annular ridge formed on an outer surface of the sleeve, and internal threads formed on an inner surface of the metal sleeve wherein the sleeve and the piercing member are formed integrally in the housing in an injection molding;

a high-pressure air canister disposed in the internal space and proximate the piercing member;

a cap including two front through holes, external threads adjacent to the front through holes, an internal primer disposed between the front through holes, at least one spacer disposed between the primer and the air canister, and an annular projection disposed at an end of the internal space and configured to complimentarily secure to the piercing member wherein the cap is disposed in the sleeve with the external threads and the internal threads secured together; and a first washer sandwiched by and between the cap and the inner surface of the internal space.

2. The cartridge of claim. 1, wherein the number of the at least one projectile is two, the projectiles disposed in two tunnels above and under the internal space respectively, and each of the projectiles including a dart, and wherein one dart is electrically conducive and has a positive electrode and the other dart is electrically conductive and has a negative electrode.

3. The cartridge of claim 1, wherein one of the projectile is disposed in a front chamber, and wherein one of the projectiles is a Capsicum annuum ball or pepper ball.

4. The cartridge of claim 3, further comprising a second washer sandwiched by and between a chamber and a front end of the housing.

5. The cartridge of claim 1, wherein the metal sleeve is made of copper or steel.

6. The cartridge of claim 1, wherein the launching device is attached to a non-lethal weapon.

7. The cartridge of claim 6, wherein the non-lethal weapon includes a light, a butt, and a trigger.

* * * * *